US009938489B2

(12) United States Patent
Tuerk et al.

(10) Patent No.: US 9,938,489 B2
(45) Date of Patent: Apr. 10, 2018

(54) PROCESS FOR CLEANING DISHWARE

(71) Applicant: BASF SE, Ludwigshafen (DE)

(72) Inventors: Holger Tuerk, Mannheim (DE); Heike Weber, Mannheim (DE); Juergen Detering, Limburgerhof (DE); Gazi Tuerkoglu, Mannheim (DE)

(73) Assignee: BASF SE, Ludwigshafen (DE)

( * ) Notice: Subject to any disclaimer, the term of this patent is extended or adjusted under 35 U.S.C. 154(b) by 125 days.

(21) Appl. No.: 14/902,776

(22) PCT Filed: Jun. 24, 2014

(86) PCT No.: PCT/EP2014/063279
§ 371 (c)(1),
(2) Date: Jan. 4, 2016

(87) PCT Pub. No.: WO2015/000744
PCT Pub. Date: Jan. 8, 2015

(65) Prior Publication Data

US 2016/0160158 A1 Jun. 9, 2016

(30) Foreign Application Priority Data

Jul. 4, 2013 (EP) ..... 13175071

(51) Int. Cl.

| | |
|---|---|
| ***B08B 9/20*** | (2006.01) |
| ***C11D 3/37*** | (2006.01) |
| ***C11D 1/72*** | (2006.01) |
| ***C11D 3/20*** | (2006.01) |
| ***C11D 3/33*** | (2006.01) |
| ***C11D 11/00*** | (2006.01) |
| ***C11D 17/00*** | (2006.01) |
| ***A47L 15/00*** | (2006.01) |

(52) U.S. Cl.
CPC ..... *C11D 3/3757* (2013.01); *A47L 15/0007* (2013.01); *C11D 1/72* (2013.01); *C11D 1/721* (2013.01); *C11D 3/2082* (2013.01); *C11D 3/2086* (2013.01); *C11D 3/33* (2013.01); *C11D 3/3761* (2013.01); *C11D 11/0023* (2013.01); *C11D 17/0091* (2013.01)

(58) Field of Classification Search
CPC ..... C11D 1/721; C11D 3/2086; C11D 3/33; C11D 3/3761; C11D 3/3757; C11D 17/0091; C11D 1/72; C11D 3/2082; C11D 11/0023; A47L 15/0007
USPC ..... 134/25.2; 510/220, 230
See application file for complete search history.

(56) References Cited

U.S. PATENT DOCUMENTS

| | | | |
|---|---|---|---|
| 5,279,756 | A | 1/1994 | Savio et al. |
| 5,719,112 | A | 2/1998 | Gordon et al. |
| 2004/0058846 | A1 | 3/2004 | Kistenmacher et al. |
| 2007/0219110 | A1 | 9/2007 | Becker et al. |
| 2011/0226288 | A1 | 9/2011 | Warkotsch et al. |
| 2012/0167923 | A1 | 7/2012 | Sendor-Mueller et al. |
| 2014/0228271 | A1 | 8/2014 | Eiting et al. |

FOREIGN PATENT DOCUMENTS

| | | | |
|---|---|---|---|
| DE | 101 04 469 | A1 | 8/2002 |
| DE | 10 2008 060 470 | A1 | 6/2010 |
| DE | 10 2009 029 635 | A1 | 3/2011 |
| DE | 10 2011 084 934 | A1 | 4/2013 |
| EP | 0 462 829 | A2 | 12/1991 |
| EP | 0 851 023 | A2 | 7/1998 |
| WO | 96/00277 | A1 | 1/1996 |
| WO | 2006/029806 | A1 | 3/2006 |
| WO | 2008/095563 | A1 | 8/2008 |

OTHER PUBLICATIONS

International Search Report dated Sep. 24, 2014 in PCT/EP2014/063279 Filed Jun. 24, 2014.

*Primary Examiner* — Eric W Golightly
(74) *Attorney, Agent, or Firm* — Oblon, McClelland, Maier & Neustadt, L.L.P.

(57) ABSTRACT

Process for cleaning dishware soiled with fatty residue, characterized in that said process is carried out at a temperature in the range of from 45 to 65° C. and using at least one formulation, comprising (A) in the range of from 1 to 50% by weight of at least one complexing agent, selected from the alkali metal salts of citric acid, aminocarboxylic acids and from sodium tripolyphosphate, (B) in the range of from 2 to 8% by weight of at least one non-ionic surfactant of general formula (I) $R^1$—CH(OH)—$CH_2$—O-$(AO)_x$—$R^2$ (I) (C) in the range of from 0.25 to less than 4% by weight of a copolymer, being obtained from copolymerizing the following comonomers (a) at least one comonomer selected from ethylenically unsaturated $C_3$-$C_4$-carboxylic acids and ethylenically unsaturated $C_4$-$C_8$-dicarboxylic acids or their respective anhydrides, (b) at least one comonomer selected from isobutene, diisobutene, $C_2$-$C_{28}$-a-olefins, and $C_{12}$-$C_{24}$-alkyl esters of (meth)acrylic acid, (c) optionally, at least one further comonomer selected from non-ionic comonomers, the integers being defined as follows: $R^1$ being selected from $C_4$-$C_{30}$-alkyl, straight-chain or branched, and from $C_4$-$C_{30}$-alkenyl, straight-chain or branched, with at least one C—C double bond, $R^2$ being selected from $C_1$-$C_{30}$-alkyl, straight-chain or branched, and from $C_2$-$C_{30}$-alkenyl, straight-chain or branched, with at least one C—C double bond, x being selected from one to 100, AO being identical or different alkylene oxides, selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O.

$$R^1\text{—CH(OH)—CH}_2\text{—O-(AO)}_x\text{—R}^2 \quad \text{(I)}$$

15 Claims, No Drawings

PROCESS FOR CLEANING DISHWARE

The present invention is directed towards a process for cleaning dishware soiled with fatty residue, characterized in that said process is carried out at a temperature in the range of from 45 to 65° C. and using at least one formulation, comprising (A) in the range of from 1 to 50% by weight of at least one complexing agent, selected from the alkali metal salts of citric acid, aminocarboxylic acids and from sodium tripolyphosphate, (B) in the range of from 2 to 8% by weight of at least one non-ionic surfactant of general formula (I)

$$R^1—CH(OH)—CH_2—O-(AO)_x—R^2 \quad (I)$$

(C) in the range of from 0.25 to less than 4% by weight of a copolymer, being obtained from copolymerizing the following comonomers (a) at least one comonomer selected from ethylenically unsaturated $C_3$-$C_4$-carboxylic acids and ethylenically unsaturated $C_4$-$C_8$-dicarboxylic acids or their respective anhydrides, (b) at least one comonomer selected from isobutene, diisobutene, $C_2$-$C_{28}$-α-olefins, and $C_{12}$-$C_{24}$-alkyl esters of (meth)acrylic acid, (c) optionally, at least one further comonomer selected from non-ionic comonomers, the integers being defined as follows:

$R^1$ being selected from $C_4$-$C_{30}$-alkyl, straight-chain or branched, and from $C_4$-$C_{30}$-alkenyl, straight-chain or branched, with at least one C—C double bond, $R^2$ being selected from $C_1$-$C_{30}$-alkyl, straight-chain or branched, and from $C_2$-$C_{30}$-alkenyl, straight-chain or branched, with at least one C—C double bond, x being selected from one to 100, AO being identical or different alkylene oxides, selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O, percentages being based on the total solids content of said formulation.

Furthermore, the present invention is directed towards formulations that are useful for cleaning dishware, and towards a process for making such formulations.

BACKGROUND OF THE INVENTION

Field of the Invention

Detergent formulations, especially detergent formulations for automatic dishwashing, have to meet various requirements. When being used in automatic dishwashing, such detergent formulations need to enable a complete cleaning of china, polymer, metal, clay, and glassware and to remove all sorts of soil, like fat, proteins, starch, dyes, and more. The soils need to be dispersed in water during the cleaning and the water removal process, and the various soils should not deposit in the dishwashing machine in case of automatic dishwashing. Finally, during the drying process, the cleaned good should exhibit a good drying behavior, without spotting.

It has been found that in many cases fatty residues are being accumulated in the fat filter or sieves of automatic dishwashing machines. Such residues usually contain surfactant and fat which has been removed from the dishware, or degradation products from soil. The deposition of residues is disadvantageous because such filters or sieves need cleaning when filled with surfactant and fat. Furthermore, such fatty residues may become smelly in case the machine is not in use for some time, and they may even become a hygiene hazard.

Mixed hydroxy ethers are particularly efficient non-ionic surfactants, especially when combined with certain polymers, see, e. g., WO 2008/095563. However, especially the use of mixed hydroxy ethers in formulations disclosed in WO 2008/095563 in automatic dishwashers can lead to rather high amounts of surfactant and fat residues in the filters or sieves.

It was therefore an objective of the present invention to provide a method for cleaning dishware soiled with fat without having to cope with significant residues of surfactant and fat in the filters or sieves of the dishwashing machine but not loss on quality of the dishwashing process. Furthermore, it was an objective to provide formulations useful for cleaning dishware soiled with fat without having to cope with significant residues of surfactant and fat in the filters or sieves of the dishwashing machine but not loss on quality of the dishwashing process. Furthermore, it was an objective to provide a method for making such formulations.

Accordingly, the processes and formulations defined in the outset have been found. Firstly, the process defined in the outset, hereinafter also referred to as inventive process, will be defined in more detail.

BRIEF SUMMARY OF THE INVENTION

The inventive process is a process for cleaning dishware. The inventive process can be carried out either manually (hand-dish-wash) or preferably with the help of a machine (machine dish-wash or automatic dish-wash). Dishes in the context of the present invention shall not only refer to plates from china but also to any kitchenware from china, metal, glass, clay or polymer, such as—but not limited to—cups, bowls and plates from china, flatware, drinking glasses such as wine glasses, champagne flutes, beer glasses and the like, and plastic kitchenware, furthermore pots, frying pans and Dutch ovens from metal such as iron, aluminum or stainless steel.

Dish-ware is provided in soiled form, among other soiled with fatty residue, also referred to as fat, that may stem from food itself or—for example in the case of frying pans—fat that stems from cooking or frying or baking food. The term "fat" may also include lard or oil, especially oil like sunflower oil, olive oil or other oil that is used for cooking purposes.

Said fatty residue may be the sole soiling of dishware to be cleaned according to the inventive process. In another embodiment of the present invention, dish-ware to be cleaned according to inventive process may be soiled with a combination of fat and at least one substance other than fat, for example pigment(s), protein, carbohydrates such as starch or sugar, caramel, furthermore lecithin, or dyestuff(s).

On the dish-ware may a coherent layer of soiling, or—in other embodiments—only one or more spots or limited areas of the respective dish-ware may be soiled.

The inventive process is being carried out at temperatures in the range of from 45 to 65° C., preferably 50 to 60° C. Said temperature refers to the temperature of the water being used in the inventive process. The inventive process is being described in more detail below.

The inventive process is being carried out using water. The amount of water is influenced by the type of machine used and by the choice of the program.

DETAILED DESCRIPTION OF THE INVENTION

Formulations used in the inventive process comprise (A) in the range of from 1 to 50% by weight, preferably 10 to 40% by weight of at least one complexing agent, hereinafter also being referred to as complexing agent (A), said complexing agent being selected from the alkali metal salts of citric acid, from the alkali metal salts of aminocarboxylic acids and from sodium tripolyphosphate.

Examples of alkali metal salts in the context of complexing agent (A) are the potassium salts and in particular the sodium salts.

Preferred alkali metal salts of citric acid are the sodium salts, especially the trisodium salt.

Preferred examples of aminocarboxylic acids are methylglycine diacetic acid (MGDA), glutamic acid diacetic acid (GLDA) and iminodisuccinic acid (IDS). Preferred alkali metal salts of aminocarboxylic acids are the trisodium salt of MGDA, the tetrasodium salt of GLDA and the tetrasodium salt of IDS.

Sodium tripolyphosphate preferably refers to the respective pentasodium salt.

In one embodiment of the present invention, said formulation may contain a combination of at least two complexing agents (A), such as, for example, a combination of alkali metal salts of citric acid and MGDA, or of citric acid and GLDA, or combinations of alkali metal salts of citric acid and sodium tripolyphosphate. Preferred are combinations of the respective sodium salts, in particular combinations of the trisodium salts of citric acid and MGDA.

Preferably, formulations used in the inventive process are phosphate-free. In the context of the present invention, the term phosphate-free refers to a combined phosphate and polyphosphate content of 0.01 or less up to 0.5% by weight of phosphate.

Formulations used in the inventive process further comprise (B) in the range of from 2 to 8% by weight, preferably up to 6% by weight of at least one non-ionic surfactant of general formula (I)

$$R^1—CH(OH)—CH_2—O-(AO)_x—R^2 \quad (I),$$

hereinafter also being referred to as "surfactant (B)", the integers being defined as follows:

$R^1$ is selected from $C_4$-$C_{30}$-alkyl, straight-chain or branched, and from $C_4$-$C_{30}$-alkenyl, straight-chain or branched, with at least one C—C double bond, preferred is $C_4$-$C_{30}$-alkyl, straight-chain or branched, more preferred is straight-chain $C_4$-$C_{30}$-alkyl and even more preferred is n-$C_{10}$-$C_{12}$-alkyl.

$R^2$ is selected from $C_1$-$C_{30}$-alkyl, straight-chain or branched, and from $C_2$-$C_{30}$-alkenyl, straight-chain or branched, with at least one C—C double bond, preferred is $C_6$-$C_{20}$-alkyl, more preferred is $C_8$-$C_{11}$-alkyl, x is selected from one to 100, preferably from 5 to 60, more preferably 10 to 50, and even more preferably 20 to 40, AO is selected from identical or different alkylene oxides, selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O. Preferred example of AO is $CH_2$—$CH_2$—O (EO).

In one embodiment of the present invention, $(AO)_x$ is selected from $(CH_2CH_2O)_{x1}$, x1 being selected from one to 50.

In one embodiment of the present invention, $(AO)_x$ is selected from —$(CH_2CH_2O)_{x2}$—$(CH_2CH(CH_3)$—$O)_{x3}$ and —$(CH_2CH_2O)_{x2}$—$(CH(CH_3)CH_2$—$O)_{x3}$, x2 and x3 being identical or different and selected from 1 to 30.

In one embodiment of the present invention, $(AO)_x$ is selected from —$(CH_2CH_2O)_{x4}$, x4=being in the range of from 10 to 50, AO being EO, and $R^1$ and $R^2$ each being independently selected from $C_8$-$C_{14}$-alkyl.

In the context of the present invention, x or x1 or x2 and x3 or x4 are to be understood as average values, the number average being preferred. Therefore, each x or x1 or x2 or x3 or x4—if applicable—can refer to a fraction although a specific molecule can only carry a whole number of alkylene oxide units.

Formulations used in the inventive process further comprise (C) in the range of from 0.25 to less than 4%, preferably 0.5 to 3.5% by weight of a copolymer, hereinafter also being referred to as copolymer (C), being obtained from copolymerizing the following comonomers (a) at least one comonomer, also being referred to as "comonomer (a)", selected from ethylenically unsaturated $C_3$-$C_4$-carboxylic acids, for example crotonic acid and preferably (meth)acrylic acid, (E)-crotonic acid, (Z)-crotonic acid, preferred is methacrylic acid and even more preferred is acrylic acid, and from ethylenically unsaturated $C_4$-$C_8$-dicarboxylic acids and their respective anhydrides, for example maleic acid, maleic anhydride, itaconic acid, itaconic anhydride, citraconic acid, metaconic anhydride and fumaric acid, preferred is maleic acid and in particular maleic anhydride, (b) at least one comonomer, also referred to as "comonomer (b)", being selected from isobutene, diisobutene, $C_2$-$C_{28}$-α-olefins, preferably from straight-chain $C_2$-$C_{28}$-α-olefins, for example ethylene, propylene, 1-butene, 1-pentene, 1-hexene, 1-octene, 1-decene, 1-dodecene, 1-tetradecene, 1-hexadecene, 1-octadecene, α-eicosene, and $CH_2$=CH-n-$C_{26}H_{53}$, preferred are $C_{10}$-$C_{28}$-α-olefins such as, 1-decene, 1-dodecene, 1-tetradecene, 1-hexadecene, 1-octadecene, α-eicosene, and $CH_2$=CH-n-$C_{26}H_{53}$ and mixtures from 1-hexadecene and 1-octadecene as well as mixtures from $C_{18}$-$C_{28}$-α-alkenes, and $C_{12}$-$C_{24}$-alkyl esters of (meth)acrylic acid, such as (meth)acrylic acid n-$C_{12}H_{25}$-ester, (meth)acrylic acid n-$C_{14}H_{29}$-ester, (meth)acrylic acid n-$C_{16}H_{33}$-ester, (meth)acrylic acid n-$C_{18}H_{37}$-ester, (meth) acrylic acid n-$C_{20}H_{41}$-ester, (meth)acrylic acid n-$C_{22}H_{45}$-ester and (meth)acrylic acid n-$C_{24}H_{49}$-ester.

(c) optionally, at least one further comonomer, also being referred to as "comonomer (c)", such comonomer (c) being selected from non-ionic comonomers and being different from both comonomer (a) and comonomer (b) and not being selected from either group of comonomers (a) and (b).

Percentages of complexing agent (A), surfactant (B) and copolymer (C) are percentages by weight and refer to the total solids content of the respective formulation.

In one embodiment of the present invention, copolymer (C) can be obtained by free radical copolymerization.

In one embodiment of the present invention, comonomer (c) is selected from α-methyl styrene, para-methyl styrene and preferably from styrene.

In a preferred embodiment of the present invention, comonomer(s) (c) are selected from the following groups:

$C_4$-$C_{10}$-alkyl esters of (meth)acrylic acid, such as n-butyl acrylate, n-butyl methacrylate, 2-ethylhexyl acrylate, 2-ethyl hexyl methacrylate, n-hexyl (meth)acrylate, n-octyl (meth)acrylate, and n-decyl (meth)acrylate, vinyl alcohol or allyl alcohol, each alkoxylated with one or more equivalents of $C_2$-$C_4$-alkylene oxide, such as—but not limited to—$CH_2$=CH—$O(AO)_yH$, y being a number in the range of from 1 to 100, in particular $CH_2$=CH—O $(CH_2CH_2O)_{y1}H$, $CH_2{=}CH{-}O(CH_2CH(CH_3)O)_{y2}H$, y1 and y2 being numbers in the range of from 1 to 100, polyalkylenglycol (meth)acrylates, such as $CH_2{=}CH{-}COO(AO)_yH$ and $CH_2{=}C(CH_3)COO(AO)_yH$, alkylen preferably being selected from ethylene, 1,2-propylen, 1,2-butylen and 1,4-butylen, y being a number in the range of from 1 to 100, and ω-hydroxyalkyl(meth)acrylates, in particular 2-hydroxyethyl(meth)acrylate, polyalkylenglycol monoalkylether (meth)acrylates, preferably polyethylenglycol mono-$C_1$-$C_{22}$-alkylether (meth) acrylates, such as $CH_2{=}CH{-}COO(AO)_yCH_3$ and $CH_2{=}C(CH_3)COO(AO)_yCH_3$, y being a number in the range of from 1 to 100, AO is being defined as above.

In the context of the present invention, y and y1 and y2 are to be understood as average values, the number average being preferred. Therefore, each y or y1 or y2—if applicable—can refer to a fraction although a specific molecule can only carry a whole number of alkylene oxide units.

In one embodiment of the present invention, copolymer (C) has an average molecular weight $M_w$ in the range of from 1,000 to 30,000 g/mol, preferably 2,000 to 10,000 g/mol, determined, for example, by gel permeation chromatography (GPC) or size exclusion chromatography, and referring to the acid/salt.

In one embodiment of the present invention, copolymer (C) exhibits a polydispersity $M_w/M_n$ in the range of from 1.5 to 10, preferably 2 to 5.

In a preferred embodiment of the present invention, copolymer (C) is used as its alkali metal salt, its carboxyl groups being partially or preferably fully neutralized with alkali, preferably with sodium.

In one embodiment of the present invention, copolymer (C) is selected from random copolymers, alternating copolymers, block copolymers and multiblock copolymers.

In one embodiment of the present invention, comonomer (a) is selected from maleic acid and maleic anhydride and comonomer (b) is selected from isobutene, diisobutene and $C_2$-$C_{28}$-α-olefins, preferably from straight-chain $C_2$-$C_{28}$-α-olefins. Such copolymers (C) are preferably alternating copolymers.

In another embodiment of the present invention, comonomer (a) is selected from (meth)acrylic acid and comonomer (b) is selected from $C_{12}$-$C_{24}$-alkyl esters of (meth)acrylic acid. Such copolymers (C) are preferably random copolymers.

In one embodiment of the present invention, copolymer (C) is made from 40 to 80% by weight of one or more comonomer(s) (a), 10 to 60% by weight of one or more comonomer(s) (b) selected from isobutene, diisobutene, and $C_2$-$C_{28}$-α-olefins, and, optionally up to 20% by weight of comonomer (c).

In another embodiment of the present invention, copolymer (C) is made from 50 to 95% by weight of one or more comonomer(s) (a), 5 to 25% by weight of one or more comonomer(s) (b) selected from $C_{12}$-$C_{24}$-alkyl esters of (meth)acrylic acid, and, optionally up to 20% by weight of comonomer (c).

Percentages are referring to the total respective copolymer (C) as free acid.

In one embodiment of the present invention, formulations used in the inventive process may have a total solids content in the range of from 90 to 99.9%, preferably 95 to 99% by weight. Such inventive formulations are, e. g., in the form of powder or tablets.

In one embodiment of the present invention, formulations used in the inventive process may have a total solids content in the range of from 15 to 40% by weight. Such inventive formulations are, e. g., in the form of gels.

In one embodiment of the present invention, the inventive process comprises several steps, one of the steps being contacting the soiled dishware with a formulation as disclosed above, and also comprising at least one rinsing step and at least one drying step. Preferably, the formulation used in the inventive process can be used as 2-in-1 or 3-in-1 formulation, and no separate rinse agent is necessary. In another preferred embodiment, the ion exchange does not need to be treated with regenerating salt. Even more preferably, the formulation used in the inventive process can be used as 2-in-1 or 3-in-1 formulation, and neither a separate rinse agent nor a regenerating salt is necessary.

In one embodiment of the present invention, formulations used in the inventive process may contain at least one further ingredient, also being referred to as ingredient (D). Ingredient (D) may be selected from one or more surfactants other than surfactant (B), one or more enzymes, one or more builders other than complexing agent (A), in particular phosphorus-free builders, one or more cobuilders, one or more alkali carriers, one or more bleaching agents, one or more bleach catalysts, one or more bleach activators, one or more bleach stabilizers, one or more antifoams, one or more corrosion inhibitors, one or more buffer or one or more dyes.

Examples of surfactants other than surfactant (B) are in particular nonionic surfactants other than surfactant (B) as well as mixtures of anionic or zwitterionic surfactants with nonionic surfactants other than surfactant (B). Preferred nonionic surfactants other than surfactant (B) are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (II)

(II)

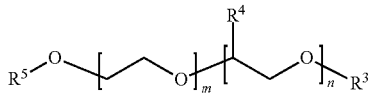

in which the variables are defined as follows:

$R^3$ is selected from hydrogen and from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, $R^4$ is identical or different and selected from linear $C_1$-$C_{10}$-alkyl, preferably in each case identical and ethyl and particularly preferably methyl, $R^5$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, m and n are in the range from zero to 300, where the sum of n and m is at least one. Preferably, m is in the range from 1 to 100 and n is in the range from 0 to 30.

Compounds of the general formula (II) may be block copolymers or random copolymers, preference being given to block copolymers.

Other preferred examples of alkoxylated alcohols and alkoxylated fatty alcohols are, for example, compounds of the general formula (III)

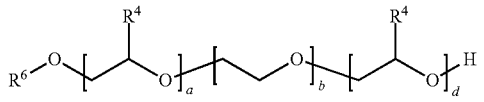

(III)

in which the variables are defined as follows:

$R^4$ is identical or different and selected from linear $C_1$-$C_4$-alkyl, preferably identical in each case and ethyl and particularly preferably methyl, $R^6$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, d is a number in the range from 4 to 25.

Compounds of the general formula (III) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants other than surfactant (B) may also be present.

Examples of anionic surfactants are $C_8$-$C_{20}$-alkyl sulfates, $C_8$-$C_{20}$-alkylsulfonates and $C_8$-$C_{20}$-alkyl ether sulfates with one to 6 ethylene oxide units per molecule.

In one embodiment of the present invention, formulations used in the inventive process can comprise in the range from 3 to 20% by weight of surfactant other than surfactant (B).

Formulations used in the inventive process can comprise one or more enzymes. Examples of enzymes are lipases, hydrolases, amylases, proteases, cellulases, esterases, pectinases, lactases and peroxidases.

Formulations used in the inventive process can comprise, for example, up to 5% by weight of enzyme, preference being given to 0.1 to 3% by weight, in each case based on the total solids content of the formulation according to the invention.

Over and above complexing agent (A), formulations used according to the invention can comprise one or more builders, in particular phosphate-free builders. Examples of suitable builders are fatty acid sulfonates, α-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers of polycarboxylates are monoethylenically unsaturated dicarboxylic acids such as maleic acid, fumaric acid, maleic anhydride, itaconic acid and citraconic acid.

A suitable (meth)acrylic acid homopolymer is in particular polyacrylic acid, which preferably has an average molecular weight $M_w$ in the range from 2,000 to 40,000 g/mol, preferably 2,000 to 10,000 g/mol, in particular 3,000 to 8,000 g/mol. Also of suitability are copolymeric polycarboxylates, in particular those of acrylic acid with methacrylic acid and of acrylic acid or methacrylic acid with maleic acid and/or fumaric acid.

Formulations used according to the invention can comprise, for example, in the range from in total 2.5 to 20% by weight, preferably up to 10% by weight, of builders other than complexing agent (A).

In one embodiment of the present invention, formulations used according to the invention can comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular importance as a cobuilder. It is preferably used as the sodium salt, the disodium salt giving a neutral reaction and the tetrasodium salt an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as hexasodium salt of EDTMP or as hepta- and octasodium salt of DTPMP. Moreover, amphoteric polymers can also be used as cobuilders.

Formulations used in the inventive process can comprise one or more alkali carriers. Alkali carriers ensure, for example, a pH of at least 9 if an alkaline pH is desired. Of suitability are, for example, alkali metal carbonates, alkali metal hydrogen carbonates, alkali metal hydroxides and alkali metal metasilicates. A preferred alkali metal is in each case potassium, particular preference being given to sodium.

Formulations used in the inventive process can comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Formulations used in the inventive process can comprise, for example, 0.5 to 15% by weight of bleaching agents, hereinafter also referred to as bleach (D). Bleach (D) can be selected from oxygen bleaches and chlorine-containing bleaches.

Examples of suitable oxygen bleaches are sodium perborate, anhydrous or for example as monohydrate or as tetrahydrate or so-called dihydrate, sodium percarbonate, anhydrous or, for example, as monohydrate, hydrogen peroxide, persulfates, organic peracids such as peroxylauric acid, peroxystearic acid, peroxy-α-naphthoic acid, 1,12-diperoxydodecanedioic acid, perbenzoic acid, peroxylauric acid, 1,9-diperoxyazelaic acid, diperoxyisophthalic acid, in each case as free acid or as alkali metal salt, in particular as sodium salt, also sulfonylperoxy acids and cationic peroxy acids.

Formulations used in the inventive process can comprise, for example, in the range from 0.5 to 15% by weight of oxygen bleach.

Suitable chlorine-containing bleaches are, for example, 1,3-dichloro-5,5-dimethylhydantoin, N—N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations used in the inventive process can preferably comprise, for example, in the range from 3 to 10% by weight of chlorine-containing bleach.

Formulations used in the inventive process can comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts). Other examples of suitable bleach activators are tetraacetylethylenediamine (TAED) and tetraacetylhexylenediamine.

Formulations used in the inventive process can comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, formulations used in the inventive process comprise in total in the range from 0.1 to 1.5% by weight of corrosion inhibitor.

Formulations used in the inventive process can comprise one or more fillers, for example sodium sulfate.

Formulations used in the inventive process can comprise one or more antifoams, selected for example from silicone oils and paraffin oils.

In one embodiment of the present invention, formulations used in the inventive process comprise in total in the range from 0.05 to 0.5% by weight of antifoam.

Dishware cleaned according to the inventive process exhibits excellent properties, such as very good removal of soiling, especially of fat. Furthermore, dishware cleaned according to the inventive process show excellent values for spotting, filming and residues. In addition, when modern dishwashing machines are used, the filter(s) and/or sieves will contain only very low amounts of surfactant and fat after operation.

A further aspect of the present invention are formulations, hereinafter also being referred to as inventive formulations, with whom the inventive process can advantageously be carried out. Inventive formulations may be unit doses, such as tablets, or as gel or powder, as granules or compactate. In a preferred embodiment, such a unit dose comprises 10 to 30 g of inventive formulation.

Inventive formulations may be solid, and in such embodiments they may contain some residual humidity, such as 0.01 to 10% by weight, water. In other embodiments, inventive formulations may be liquids or gels.

Inventive formulations comprise (A) in the range of from 1 to 50% by weight, preferably 10 to 40% by weight of at least one complexing agent (A), said complexing agent being selected from the alkali metal salts of citric acid, from the alkali metal salts of aminocarboxylic acids and from sodium tripolyphosphate.

Examples of alkali metal salts in the context of complexing agent (A) are the potassium salts and in particular the sodium salts.

Preferred alkali metal salts of citric acid are the sodium salts, especially the trisodium salt.

Preferred examples of aminocarboxylic acids are methylglycine diacetic acid (MGDA), glutamic acid diacetic acid (GLDA) and iminodisuccinic acid (IDS). Preferred alkali metal salts of aminocarboxylic acids are the trisodium salt of MGDA, the tetrasodium salt of GLDA and the tetrasodium salt of IDS.

Sodium tripolyphosphate preferably refers to the respective pentasodium salt.

In one embodiment of the present invention, inventive formulations may contain a combination of at least two complexing agents (A), such as, for example, a combination of alkali metal salts of citric acid and MGDA, or of citric acid and GLDA, or combinations of alkali metal salts of citric acid and sodium tripolyphosphate. Preferred are combinations of the respective sodium salts, in particular combinations of the trisodium salts of citric acid and MGDA.

Preferably, inventive formulations are phosphate-free. In the context of the present invention, the term phosphate-free refers to a combined phosphate and polyphosphate content of 0.01 or less up to 0.5% by weight of phosphate.

Inventive formulations further comprise (B) in the range of from 2 to 8% by weight, preferably 3 to 6% by weight of surfactant (B)

$$R^1—CH(OH)—CH_2—O-(AO)_x—R^2 \quad (I),$$

the integers being defined as follows:

$R^1$ is selected from $C_4$-$C_{30}$-alkyl, straight-chain or branched, and from $C_4$-$C_{30}$-alkenyl, straight-chain or branched, with at least one C—C double bond, preferred is $C_4$-$C_{30}$-alkyl, straight-chain or branched, more preferred is straight-chain $C_4$-$C_{30}$-alkyl and even more preferred is n-$C_{10}$-$C_{12}$-alkyl.

$R^2$ is selected from $C_1$-$C_{30}$-alkyl, straight-chain or branched, and from $C_2$-$C_{30}$-alkenyl, straight-chain or branched, with at least one C—C double bond, preferred is $C_6$-$C_{20}$-alkyl, more preferred is $C_8$-$C_{11}$-alkyl.

x is selected from one to 100, preferably from 5 to 60, more preferably 10 to 50, and even more preferably 20 to 40, AO is selected from identical or different alkylene oxides, selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O. Preferred example of AO is $CH_2$—$CH_2$—O (EO).

In one embodiment of the present invention, $(AO)_x$ is selected from $(CH_2CH_2O)_{x1}$, x1 being selected from one to 50.

In one embodiment of the present invention, $(AO)_x$ is selected from —$(CH_2CH_2O)_{x2}$—$(CH_2CH(CH_3)—O)_{x3}$, x2 and x3 being identical or different and selected from 1 to 30.

In one embodiment of the present invention, $(AO)_x$ is selected from —$(CH_2CH_2O)_{x4}$, x4=being in the range of from 10 to 50, AO being EO, and $R^1$ and $R^2$ each being independently selected from $C_8$-$C_{14}$-alkyl.

Inventive formulations further comprise (C) in the range of from 0.25 to less than 4%, preferably 0.5 to 3.5% by weight of copolymer (C), being obtained from copolymerizing the following comonomers (a) at least one comonomer (a), selected from ethylenically unsaturated $C_3$-$C_4$-carboxylic acids, for example crotonic acid and preferably (meth)acrylic acid, (E)-crotonic acid, (Z)-crotonic acid, preferred is methacrylic acid and even more preferred is acrylic acid, and from ethylenically unsaturated $C_4$-$C_8$-dicarboxylic acids and their respective anhydrides, for example maleic acid, maleic anhydride, itaconic acid, itaconic anhydride, citraconic acid, metaconic anhydride and fumaric acid, preferred is maleic acid and in particular maleic anhydride, (b) at least one comonomer (b), being selected from isobutene, diisobutene, $C_2$-$C_{28}$-α-olefins, preferably from straight-chain $C_2$-$C_{28}$-α-olefins, for example ethylene, propylene, 1-butene, 1-pentene, 1-hexene, 1-octene, 1-decene, 1-dodecene, 1-tetradecene, 1-hexadecene, 1-octadecene, and α-eicosene, preferred are $C_{10}$-$C_{20}$-α-olefins such as, 1-decene, 1-dodecene, 1-tetradecene, 1-hexadecene, 1-octadecene, and mixtures from 1-hexadecene and 1-octadecene, and $C_{12}$-$C_{24}$-alkyl esters of (meth)acrylic acid, such as (meth)acrylic acid n-$C_{12}H_{25}$-ester, (meth)acrylic acid n-$C_{14}H_{29}$-ester, (meth)acrylic acid n-$C_{16}H_{33}$-ester, (meth)acrylic acid n-$C_{18}H_{37}$-ester, (meth) acrylic acid n-$C_{20}H_{41}$-ester, and (meth)acrylic acid n-$C_{24}H_{49}$-ester.

(c) optionally, at least one comonomer (c) selected from non-ionic comonomers, such comonomer (c) being different from both comonomer (a) and comonomer (b) and not being selected from either group of comonomers (a) and (b).

Percentages of complexing agent (A), surfactant (B) and copolymer (C) are percentages by weight and refer to the total solids content of the respective formulation.

Comonomers (a), (b) and (c) have been defined above.

Preferably, inventive formulations are phosphate-free.

In one embodiment of the present invention, copolymer (C) has an average molecular weight $M_w$ in the range of from 1,000 to 30,000 g/mol, preferably up to 10,000 g/mol, determined by GPC.

In one embodiment of the present invention, copolymer (C) exhibits a polydispersity $M_w/M_n$ in the range of from 1.5 to 10, preferably 2 to 5.

In a preferred embodiment of the present invention, copolymer (C) is used as its alkali metal salt, its carboxyl groups being partially or preferably fully neutralized with alkali, preferably with sodium.

In one embodiment of the present invention, copolymer (C) is selected from random copolymers, alternating copolymers, block copolymers and multiblock copolymers.

In one embodiment of the present invention, comonomer (a) is selected from maleic acid and maleic anhydride and comonomer (b) is selected from isobutene, diisobutene and $C_2$-$C_{28}$-α-olefins, preferably from straight-chain $C_2$-$C_{28}$-α-olefins. Such copolymers (C) are preferably alternating copolymers.

In another embodiment of the present invention, comonomer (a) is selected from (meth)acrylic acid and comonomer (b) is selected from $C_{12}$-$C_{24}$-alkyl esters of (meth)acrylic acid. Such copolymers (C) are preferably random copolymers.

In one embodiment of the present invention, inventive formulations have a total solids content in the range of from 90 to 99.9%, preferably 95 to 99% by weight. Such inventive formulations are, e. g., in the form of powder or tablets.

In one embodiment of the present invention, inventive formulations have a total solids content in the range of from 15 to 40% by weight. Such inventive formulations are, e. g., in the form of gels.

In one embodiment of the present invention, inventive formulations may contain at least one further ingredient, also being referred to as ingredient (D). Ingredient (D) may be selected from one or more surfactants other than surfactant (B), one or more enzymes, one or more builders other than complexing agent (A), in particular phosphorus-free builders, one or more cobuilders, one or more alkali carriers, one or more bleaching agents, one or more bleach catalysts, one or more bleach activators, one or more bleach stabilizers, one or more antifoams, one or more corrosion inhibitors, one or more buffer or one or more dyes. Ingredients (D) have been explained in more detail above.

Inventive formulations are excellently suitable for carrying out the inventive process.

A further aspect of the present invention is a process for making inventive formulations, hereinafter also being referred to as inventive manufacturing process. The inventive manufacturing process comprises mixing complexing agent (A), surfactant (B) and copolymer (C) and, if applicable, one or more further ingredient (D), in one or more steps. Such mixing can be performed in the absence or presence of water, preferably mixing is being performed in the absence of water. In other embodiments, at least one of the components complexing agent (A), surfactant (B) and copolymer (C) or, if applicable, one or more further ingredient (D), is added as aqueous solution to other components that are powdery or in the form of granules, and the water is being removed during or after mixing. Mixing can be performed at a temperature in the range of from 5 to 100° C., preferably 20 to 70° C. or at ambient temperature.

In one embodiment of the present invention, the inventive manufacturing process is being carried out in the presence of water, and such water is at least partially removed at the end of the inventive manufacturing process, for example by spray-drying or by making compactates of granules of different components or of premixed components.

EXAMPLES

The invention is further explained by the following working examples.

The following ingredients were used:

(A.1): trisodium salt of methyl glycine diacetic acid (A.2): trisodium salt of citric acid Surfactant (B.1): n-$C_8H_{17}$—CH(OH)—$CH_2$—O-$(EO)_{22}$—$CH(CH_3)$—$CH_2$—O-n-$C_{10}H_{21}$ Surfactant (B.2): n-$C_{10}H_{21}$—CH(OH)—$CH_2$—O-$(EO)_{40}$-n-$C_{10}H_{21}$ Copolymer (C.1): fully neutralized sodium salt of random copolymer from maleic acid anhydride (a.1), $CH_2$=CH-n-$C_{16}H_{33}$ (b.1)/isobutene (b.2); 65% by weight of (a.1), 9% by weight of (b.1), 26% by weight of (b.2), percentages referring to the respective free acid of (C.1)

Synthesis of Copolymer (C.1):

O-Xylene (363 g) and maleic acid anhydride (a.1) (196 g) were placed in an autoclave equipped with metering and distillation devices and a stirrer. The autoclave was purged with 3 bar of nitrogen three times. The pressure was then reduced to 91 mbar and the mixture of (a.1) and o-xylene was heated to 120° C. The following feeds were added simultaneously at 120° C., each with constant rate, starting at the same time:

25.2 g $CH_2$═CH-n-$C_{16}H_{33}$ (b.1) over a period of 3 hours, 78.4 g of isobutene (b.2) over a period of 5 hours and tert-butylperoxy-2-ethylhexanoate (8.31 g) dissolved in 35 g o-xylene over a period of 5.5 hours. When the addition of tert-butylperoxy-2-ethylhexanoate had been completed, the reaction mixture was further stirred for 1 hour at 120° C. The pressure in the autoclave was then released to atmospheric pressure. The reaction mixture was cooled to 100° C. and then diluted with 310 ml of water. O-Xylene was then removed by steam distillation. The mixture so obtained was neutralized by addition of 205 ml 50 wt % aqueous sodium hydroxide solution within 2 hours and then cooled to room temperature to yield a clear solution with a solid content of 40 wt %. Average molecular weight $M_w$: 4330 g/mol, as sodium salt, partially neutralized (pH value: 7)

Copolymer (C.2): fully neutralized sodium salt of random copolymer from acrylic acid (a.2)/methacrylic acid stearyl ester (b.3), 90% by weight of (a.2), 10% by weight of (b.3), percentages referring to the respective free acid Synthesis of Copolymer (C.2):

A polymerization vessel equipped with an anchor stirrer and metering devices was charged with a solution of 5 g od acrylic acid (a.2) in 175 g of isopropanol. The mixture was heated to 80° C. under an atmosphere of nitrogen. The following feeds were added simultaneously at 80° C., each with constant rate, starting at the same time:

a solution of 175 g of acrylic acid (a.2) in 200 g of isopropanol, over a period of 6 hours, a solution of 20 g of methacrylic acid stearyl ester (b.3) in 200 g of isopropanol over a period 5.5 hours, and 9.5 g tert-butyl perpivalate, dissolved in 50 g of isopropanol within 6.5 hours. When the addition of the tert-butyl perpivalate had been completed, the resulting reaction mixture was further stirred at 80° C. for 1 hour, and another 2.7 g of tert-butylperoxypivalate, dissolved in 10 g of isopropanol, were added. Then the reaction mixture so obtained was further stirred for 1 hour at 80° C. Isopropanol was removed by means of steam distillation. The pH value of aqueous mixture so obtained was adjusted to 7.0 with aqueous sodium hydroxide solution to yield a clear aqueous polymer solution with a solid content of 23.2 wt. %. $M_w$: 5180 g/mol.

The weight-average molecular weight ($M_w$) of copolymer (C.2) was determined by GPC (gel permeation chromatography) at 23° C., using a PSS Suprema column (PSS, Mainz, Germany). The eluent employed was an aqueous tris(hydroxymethyl)amino methane (TRIS) buffer solution (0.02 M), containing 0.2 M sodium chloride. A differential refractometer was used for detection. Calibration was carried out using dextran/pullulan standards.

(D.3): Polyacrylic acid $M_w$ 4000 g/mol, as sodium salt, completely neutralized The following base detergent composition was used:

TABLE 1

Base mixtures for experiments with formulations according to the invention and comparison formulations

| Feed material | Base-1 |
|---|---|
| Protease | 2.5 |
| Amylase | 1 |
| (B.1) | 4 |
| (B.2) | 1 |
| Sodium percarbonate (D.1) | 10.5 |
| TAED | 4 |
| $Na_2Si_2O_5$, commercial product (Britesil ®) | 2 |
| $Na_2CO_3$ | 19.5 |
| (A.1) | 10 |
| Sodium citrate dehydrate (A.2) | 35 |
| HEDP | 0.5 |

All data in g.

Firstly, base mixtures were prepared from the feed materials according to table 1. The feed materials as well as copolymer (C.1), copolymer (C.2) and/or polymer (D.3) were mixed in dry state apart from (B.1) and (B.2), which were finally added in molten form.

General Remarks about the Dish-Wash Process:

Rinsing Experiments:

All dish-wash experiments were carried out in Miele automatic dish wash machines, type G1222 SCL. The program 50° C. ("R-time 2", for washing) and 65° for rinsing was selected. No separate rinsing agent was added, no regenerating salt was used. The dish-wash experiments were carried out with water, 21° dH (German hardness), Ca/Mg: $HCO_3$ (3:1):1.35. In each experiment three knives (stainless steel), three blue melamine resin plates, three drinking glasses and three plates from china were placed in the dishwasher. Before each cycle 100 g of soil, comprising fat, protein and starch in the form of margarine, egg-yolk and starch, were added. In each cycle, 18 g of a formulation according to tables 1 and 2 were added.

Between two cycles, a waiting period of one hour was left, of which 10 minutes were with the door of the dishwashing machine closed and 50 minutes with open door. The dishes were checked by visual assessment of the ware after 6 cycles in a darkened chamber under light behind an aperture diaphragm was awarded using a grading scale from 1 (very poor) to 10 (very good). In addition, the sieves of the machines were checked by visual assessment and rated using average grades from 1 (high amounts of greasy residues) to 5 (clean sieve).

Base mixture according to table 1, (D.3) and copolymer (C.1) were mixed according to table 2 and tested. The results are summarized in table 2.

TABLE 2

Rinsing Test

| Formulation | base mixture [g] | (C.1) [g] | (D.3) [g] | Spotting, knives | Spotting, glass | Spotting, china | Filming, knives | Filming, glass | Filming, china | Sieves (grade) |
|---|---|---|---|---|---|---|---|---|---|---|
| C-TF.1 | 16.2 | — | 1.8 | 10 | 2 | 9 | 7 | 5 | 7.7 | 3 |
| TF.2 | 16.2 | 0.45 | 1.35 | 10 | 5.3 | 9.3 | 8.3 | 5.7 | 9 | 5 |

"Sieves (grade)" refers to an average grade. The sieves and filters only contained very little fat and detergent when TF.2 was used. When C-TF.1 was used, soiling of the sieve could be observed after the $6^{th}$ cycle.

Residue Removal Experiments:

All dish-wash experiments were carried out in Miele automatic dish wash machines, type G1222 SCL. The program 65° C. for washing and rinsing was selected. No separate rinsing agent was added, no regenerating salt was used. The dish-wash experiments were carried out with water, 21° dH (German hardness), Ca/Mg:$HCO_3$ (3:1):1.35. In each experiment three knives (stainless steel), three blue melamine resin plates, three drinking glasses and three plates from china were placed in the dishwasher. Together with the detergent 50 g of the ballast soil according to table 4 was added into the dish wash machine. In each cycle, 18 g of a formulation according to tables 1 and 3 was added.

Between two cycles, a waiting period of one hour was left, of which 10 minutes were with the door of the dishwashing machine closed and 50 minutes with open door. The dishes were checked by visual assessment of the ware after 30 cycles in a darkened chamber under light behind an aperture diaphragm was awarded using a grading scale from 1 (very poor) to 10 (very good). In addition, the sieves of the machines were checked by visual assessment and rated using average grades from 1 (high amounts of greasy residues) to 5 (clean sieve).

TABLE 3

Residue Tests

| Formulation | base mixture [g] | (C.1) [g] | (D.3) [g] | Filming, knives | Filming, glass | Filming, melamine | Filming, china | Sieves (grade) |
|---|---|---|---|---|---|---|---|---|
| C-TF.3 | 16.2 | — | 1.8 | 5 | 3 | 3 | 6.3 | 1 |
| TF.4 | 16.2 | 0.23 | 1.57 | 6.7 | 3 | 6.7 | 6.3 | 4 |
| TF.5 | 16.2 | 0.45 | 1.35 | 5 | 3 | 9 | 6.7 | 5 |

"Sieves (grade)" refers to an average grade. The sieves and filters only contained very little fat and detergent when TF.4 or TF.5 was used. When C-TF.3 was used, strong soiling of the sieve could be observed after the 30$^{th}$ cycle.

When copolymer (C.2) was used instead of copolymer (C.1) the same trend was observed.

TABLE 4

Composition of soil for rinsing experiments

| Soil component | | % by weight |
|---|---|---|
| Starch | Potato starch | 0.5 |
| | Gravy | 2.5 |
| Oil/grease | margarine | 10.2 |
| Protein | Egg yolk | 5.1 |
| | Reduced fat milk | 5.1 |
| Others | Tomato ketchup | 2.5 |
| | Mustard | 2.5 |
| | Benzoic acid | 0.1 |
| | Demineralized water | 71.5 |
| Sum | | 100 |

The invention claimed is:

1. A process for cleaning dishware soiled with fatty residue, the process comprising cleaning dishware soiled with fatty residue at a temperature in the range of from 45 to 65° C. with a formulation, comprising (A) from 1 to 50% by weight of at least one complexing agent, selected from the alkali metal salts of citric acid, of aminocarboxylic acids and from sodium tripolyphosphate, (B) from 2 to 8% by weight of a non-ionic surfactant of formula (I)

$$R^1—CH(OH)—CH_2—O-(AO)_x—R^2 \quad (I)$$

(C) of from 0.25 to less than 4% by weight of a copolymer, being obtained from copolymerizing the following comonomers:

(a) at least one comonomer selected from the group consisting of ethylenically unsaturated $C_3$-$C_4$-carboxylic acids and ethylenically unsaturated $C_4$-$C_8$-dicarboxylic acids or their respective anhydrides, (b) at least one comonomer selected from the group consisting of isobutene, diisobutene, $C_2$-$C_{28}$-α-olefins, and $C_{12}$-$C_{24}$-alkyl esters of (meth)acrylic acid, wherein $R^1$ is a $C_4$-$C_{30}$-alkyl, straight-chain or branched, or a $C_4$-$C_{30}$-alkylene comprising a carbon carbon double bond, straight-chain or branched, $R^2$ is a $C_1$-$C_{30}$-alkyl, straight-chain or branched, or a $C_2$-$C_{30}$-alkylene comprising a carbon carbon double bond, straight-chain or branched, x is a number from one to 100, AO are each independently $CH_2$—$CH_2$—O, $(CH_2)_3$—O, $(CH_2)_4$—O, $CH_2CH(CH_3)$—O, $CH(CH_3)$—$CH_2$—O— or $CH_2CH(n\text{-}C_3H_7)$—O, an average molecular weight $M_w$ of copolymer C is from 1,000 to 30,000 g/mol, wherein the percentages are based on the total solids content of said formulation, and wherein the process is carried out with the help of a machine as machine dishwash or automatic dishwash.

2. The process according to claim 1, wherein the formulation comprises from 10 to 40% by weight of complexing agent (A).

3. The process according to claim 1, wherein the complexing agent (A) is selected from the group consisting of an alkali metal salt of methyl glycine diacetate (MGDA), an alkali metal salt of imino succinic acid (IDS) and an alkali metal salt of glutamic acid diacetate (GLDA).

4. The process according to claim 1, wherein the average molecular weight $M_w$ of the copolymer (C) is from 2,000 to 10,000 g/mol.

5. The process according to claim 1, wherein the copolymer (C) further comprises: a comonomer (c) which is selected from the group consisting of a sulfo group containing ethylenically unsaturated comonomer, a $C_4$-$C_{10}$-alkyl ester of (meth)acrylic acid, a $C_2$-$C_4$-alkylene oxide alkoxylated vinyl alcohol, a polyalkylenglycol (meth)acrylate, a polyalkylenglycol monoalkylether (meth)acrylate, and an ω-hydroxyalkyl(meth)acrylate.

6. The process according to claim 1, wherein the formulation further comprises an alkali metal salt of a (meth) acrylic acid homopolymer.

7. The process according to claim 1, wherein the copolymer (C) is an alternating copolymer in which comonomer (a) is selected from maleic acid and maleic anhydride.

8. A formulation, comprising:

(A) from 1 to 50% by weight of at least one complexing agent, selected from the group consisting of an alkali metal salt of citric acid, an alkali metal salt of an aminocarboxylic acid, and sodium tripolyphosphate, (B) from 2 to 8% by weight of a non-ionic surfactant of formula (I)

$$R^1—CH(OH)—CH_2—O-(AO)_x—R^2 \quad (I)$$

(C) from 0.25 to less than 4% by weight of a copolymer, comprising as copolymerized units:

(a) at least one comonomer selected from the group consisting of ethylenically unsaturated $C_3$-$C_4$-carboxylic acids and ethylenically unsaturated $C_4$-$C_8$-dicarboxylic acids or their respective anhydrides, (b) at least one comonomer selected from the group consisting of isobutene, diisobutene, $C_2$-$C_{28}$-α-olefins, and $C_{12}$-$C_{24}$-alkyl esters of (meth)acrylic acid, wherein $R^1$ is a $C_4$-$C_{30}$-alkyl, straight-chain or branched, or a $C_4$-$C_{30}$-alkylene comprising a carbon carbon double bond, straight-chain or branched, $R^2$ is a $C_1$-$C_{30}$-alkyl, straight-chain or branched, or a $C_2$-$C_{30}$-alkylene comprising a carbon carbon double bond, straight-chain or branched, x is a number from one to 100, AO are each independently $CH_2$—$CH_2$—O, $(CH_2)_3$—O, $(CH_2)_4$—O, $CH_2CH(CH_3)$—O, $CH(CH_3)$—$CH_2$—O— or $CH_2CH(n\text{-}C_3H_7)$—O, an average molecular weight $M_w$ of copolymer C is from 1,000 to 30,000 g/mol, wherein the percentages are based on the total solids content of the formulation.

9. The formulation according to claim 8, wherein the formulation comprises 10 to 40% by weight the complexing agent (A).

10. The formulation according to claim 8, wherein the complexing agent (A) is selected from the group consisting of an alkali metal salt of methyl glycine diacetate (MGDA), an alkali metal salt of imino succinic acid (IDS) and an alkali metal salt of glutamic acid diacetate (GLDA).

11. The formulation according to claim 8, wherein the copolymer (C) further comprises: a comonomer (c) which is selected from the group consisting of a sulfo group containing ethylenically unsaturated comonomer, a $C_4$-$C_{10}$-alkyl ester of (meth)acrylic acid, a $C_2$-$C_4$-alkylene oxide alkoxylated vinyl alcohol, a polyalkylenglycol (meth)acrylate, a polyalkylenglycol monoalkylether (meth)acrylate, and an ω-hydroxyalkyl(meth)acrylate.

12. The formulation according to claim 8, wherein the formulation further comprises an alkali metal salt of a (meth)acrylic acid homopolymer.

13. The formulation according to claim 8, wherein the average molecular weight $M_w$ of the copolymer (C) is from 2,000 to 10,000 g/mol.

14. The formulation according to claim 8, wherein the copolymer (C) is an alternating copolymer.

15. The formulation according to claim 8, wherein the copolymer (C) is an alternating copolymer in which comonomer (a) is selected from maleic acid and maleic anhydride.

* * * * *